US008117925B2

(12) United States Patent
Yiu

(10) Patent No.: US 8,117,925 B2
(45) Date of Patent: Feb. 21, 2012

(54) APPARATUS AND METHOD FOR USING A TIP COLLAR ON PIPETTE TIPS PROVIDING STRUCTURAL RIGIDITY

(76) Inventor: Felix H. Yiu, Northridge, CA (US)

( * ) Notice: Subject to any disclaimer, the term of this patent is extended or adjusted under 35 U.S.C. 154(b) by 501 days.

(21) Appl. No.: 11/774,431

(22) Filed: Jul. 6, 2007

(65) Prior Publication Data

US 2009/0007702 A1 Jan. 8, 2009

(51) Int. Cl.
*B01L 3/02* (2006.01)

(52) U.S. Cl. ..... 73/863.32

(58) Field of Classification Search ..... 73/864.17, 73/863.32

See application file for complete search history.

(56) References Cited

U.S. PATENT DOCUMENTS

| | | | | |
|---|---|---|---|---|
| 3,982,438 | A * | 9/1976 | Byrd | 73/863.32 |
| 4,565,100 | A * | 1/1986 | Malinoff | 73/863.32 |
| 6,841,130 | B2 * | 1/2005 | Lehtinen et al. | 422/100 |
| 2003/0129089 | A1 * | 7/2003 | Arnold et al. | 422/63 |
| 2005/0178217 | A1 * | 8/2005 | Carl | 73/863.32 |
| 2006/0144169 | A1 * | 7/2006 | Porat et al. | 73/864.14 |

* cited by examiner

*Primary Examiner* — Robert R Raevis

(74) *Attorney, Agent, or Firm* — Charles C. H. Wu; Wu & Cheung, LLP

(57) ABSTRACT

The present invention relates to an apparatus for assembling together a plurality of pipette tips using a tip collar that will provide structural rigidity to the plurality of pipette tips and the method of incorporating such an apparatus. Such rigidity created by the tip collar apparatus will allow for an innovative method of connecting the plurality of pipette tips to their respective pipettors that will reduce the amount of downward axial force required to impinge the plurality of pipette tips using the traditional connection method.

2 Claims, 8 Drawing Sheets

APPARATUS AND METHOD FOR USING A TIP COLLAR ON PIPETTE TIPS PROVIDING STRUCTURAL RIGIDITY

BACKGROUND OF INVENTION

1. Technical Field of the Invention

The invention relates in general to a tip collar for a plurality of pipette tips that can be used to provide structural rigidity by forming a single entity thereby allowing a simplified and improved method of assembling together the plurality of pipette tips for transportation and operation.

2. Description of the Related Art

Pipetting systems are used in laboratories to help transfer relatively small quantities of fluid in a precise and accurate manner. Pipettors generally are made out of a disposable material due to the fact that they need to dispose of after each operation to avoid contaminants. Ultimately, based on such a need, it is customary to separate the pipette tips from the actual pipettors and make only the pipette tips disposable after each operation. This set up is hugely advantageous, as pipette tips are relatively easy and inexpensive to replace.

In order to take advantage of this connection between a disposable pipetting tip and the actual pipettor, the disposable pipette tips need to mount easily onto the actual shaft of the pipettor, while at the same time the connection needs to be secure and stable enough to prevent wiggling of the pipette tips. Lastly and most importantly, the pipette tips must form a tight seal with the pipettor in order to ensure that the desired quantity of fluid is not unintentionally altered.

In order to achieve all of the above mentioned objectives of connecting the pipetting tip to the pipettor, what is generally done in the field is to use a pipette tip in which the top surface is made out of a hollow elongated conical shape with an open proximal end which allows the shaft of the pipettor to be inserted into the top surface of the pipette tip. However, in order to create a tight seal between the shaft of the pipettor and the pipette tips, a large downward axial force is required to be exerted on the pipette tips from the pipettor. This large axial force generally causes the internal surface of the conical shaped proximal end of the pipette tips to deform, before an actual tight seal could be created.

This large axial force required to create such a tight seal is exponentially expanded when more than one pipette tip is required to be mounted to the shaft of the pipettor. Generally, due to the need for experimental repetition, pipettors come in groups of over 300 per set to allow duplication of the results. Because of that set up, pipette tips come in a rectangular array of 16 by 24, yielding 384 pipette tips that all need to be mounted to their respective pipettors simultaneously. Obviously, the force required to such a mounting process involving multiple pipette tips needs to be significant, and can easily exceed five hundred lbs.

Conversely, with the current conventional set up, a very high ejecting force is also required when the pipette tips are ejected from the pipettors. This high ejecting force can sometimes exceed the large axial loading force above, and creates an inefficient way of loading and unloading pipette tips.

Moreover, because of the difficulties inherent within aligning a pipettor to the respective multiple pipette tips, occasionally the misalignment causes breakage of the pipette tips. The breakage of the pipette tips occurs partially because of the exceedingly excessive force required to create the multiple seals. Consequently, even minor misalignment could cause significant breakage.

Prior inventions such as Externally Sealed Pipette ("ESP") tips have attempted to address the excessive sealing force issue by using an alternate method of creating multiple seal rings at the external surfaces of the top surface of the pipette tips instead of the internal surfaces of the top surface. Pipettors designed for use with these ESP type tips are comprised of a pipette block or dispensing head apparatus and stripping plate through which the pipette tips are loaded. Such a method helps better align the pipette tips with their respective pipettors, and consequently, reduces the amount of downward axial force required to generate the desired seal. However, such methods still require a downward axial force to ensure that the desired seal is created. Such a force is still very high when faced with multiple pipettors those need to be sealed with multiple pipette tips. In addition, in this method pipette tips are not released from the dispensing head apparatus in one motion, but rather are removed a few tips at a time.

FIG. 5(*a*) illustrates a relationship between a prior art pipettor and a prior art pipette tip right before the connection is made using a single shaft of the pipettor.

Pipette tip 500 here shown in FIG. 5(*b*) connects with the pipettor 502 by receiving the pipettor 502 within the internal walls of its open proximal end. This insertion creates the desired seal 504 within the internal walls of the pipette tip 500. This connection and seal 504 requires significant downward axial force to ensure that the seal 504 between the pipette tip 500 and pipettor 502 are secure and snug. This force required to create such a seal can be exponentially greater when the multiple pipettor are used, and multiple seals are created.

Finally, in operation of connecting multiple pipette tips to the mounting shaft or external connectors of the microplates of a pipettor, the lack of structural rigidity will cause some of the pipette tips to be mounted at different axial orientations. Consequently, the lack of structural rigidity inherent in the gathering of the multiple pipette tips makes it difficult to generate the correct axial mounting orientation, thus preventing the creation of a desirable seal.

Due to the foregoing, it can be seen that there is a need in the art for gathering and assembling together a set of more than one pipette tips creating an apparatus that allows multiple pipette tips to be transported with ease as well as providing structural rigidity that will allow an alternative connection method eliminating the unduly excessive downward axial force.

Consequently, it would be an advance in the art to provide a tip collar that provides structural rigidity to the set of multiple pipette tips that will allow for an innovative method of creating the desired seal, thus reducing the downward axial force required to create a traditional seal. Moreover, such an innovative tip collar will allow a more automatic process of pipetting procedures that will eliminate the steps needed to align, connect, and disconnect traditional set of multiple pipette tips from their respective pipettors.

SUMMARY OF THE INVENTION

To minimize the limitations found in the prior art, and to minimize other limitations that will be apparent upon the reading of the specifications, the present invention provides an apparatus and a method for assembling together a plurality of pipette tips that will allow an innovative way to use an upward lifting force on the entire set of multiple pipette tips to create the desired seal. The desired seal can now be formed at a top surface of the set of multiple pipette tips because the tip collar apparatus provides sufficient structural rigidity that no downward axial force is required between the pipettor and the pipette tips in order to ensure a proper seal.

An apparatus in accordance with the present invention comprises of a tip collar for assembling together a plurality of pipette tips comprising, a plurality of protruding tabs placed at a pair of opposite sides of the tip collar adaptable for easy insertion and removal of the combined structure of the tip collar and the pipette tips, and a plurality of axially placed holes within the tip collar designed for receiving the top surface of the plurality of pipette tips and preventing the open proximal ends of the plurality of pipette tips from deforming due to the axial force or pressure exerted from the pipettor; wherein the tip collar provides structural rigidity to the plurality of pipette tips by forming an assembly set of pipette tips.

Moreover, an additional apparatus in accordance with the present invention comprises of a tip collar for assembling together a plurality of pipette tips comprising a plurality of tabs protruding at a pair of opposite sides of the tip collar, and a plurality of axially placed holes within the tip collar adaptable for receiving the plurality of pipette tips.

A method in accordance with the present invention assembles together the plurality of pipette tips comprising the steps of engaging the plurality of pipette tips arranged in a pipetting head adaptor with the tip collar having the plurality of axially placed holes to create the assembly set of pipette tips and connecting the assembly set of pipette tips to the pipettor by using an upward lifting force on the assembly set of pipette tips.

It is an objective of the invention to create a unitary entity between the set of multiple pipette tips and a tip collar that provides structural rigidity to allow for ease of installation between the assembly set of pipette tips and a pipetting head adaptor.

It is another objective of the invention to create an assembly set of pipette tips that is easily adaptable to fit onto an automated pipettor machine.

It is yet another objective of the invention to create an apparatus that allows ease of installation between multiple pipette tips and a pipetting head adaptor.

It is yet another objective of the present invention to create a relatively low maintenance apparatus that is capable of accurately mating with an assembly set of pipette tips.

It is yet another objective of the present invention to provide an assembly set of pipette tips that can be easily disposable.

It is yet another objective of the present invention to create an apparatus for assembling multiple pipette tips that is inexpensive to manufacturer.

It is yet another objective of the present invention to utilize the tip collar to greatly reduce the amount of force that is required to create a seal between a pipette tip and a pipettor.

It is yet another objective of the present invention to reduce the amount of force that is required to eject the pipette tips from the respective pipettors.

It is yet another objective of the present invention to utilize the tip collar to eliminate tip breakage occurring at the pipette tips.

It is yet another objective of the present invention to create a seal at the top surface of the pipette tips when connected to a pipettor using a gasket mating instead of through interference within the internal walls of the open proximal end of the pipette tips.

It is yet another objective of the present invention to allow a seal to be created using an upward lifting force instead of a downward impinging axial force.

It is yet another objective of the present invention to allow a pipettor to connect to a plurality of pipette tips without breaking the pipette tips.

These and other advantages and features of the present invention are described with specificity so as to make the present invention understandable tone of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

FIG. 5(*b*) is using a single shaft of a pipettor to illustrate the relationship between a prior art pipettor and a prior art pipette tip after the parts have been connected creating a seal within the internal surfaces of the pipette tip.

FIG. 6(*b*) illustrates the relationship between a pipettor utilizing the current invention and a pipette tip also utilizing the current invention after the parts have been connected creating a seal within the top surface of the pipette tip.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Figure 1:
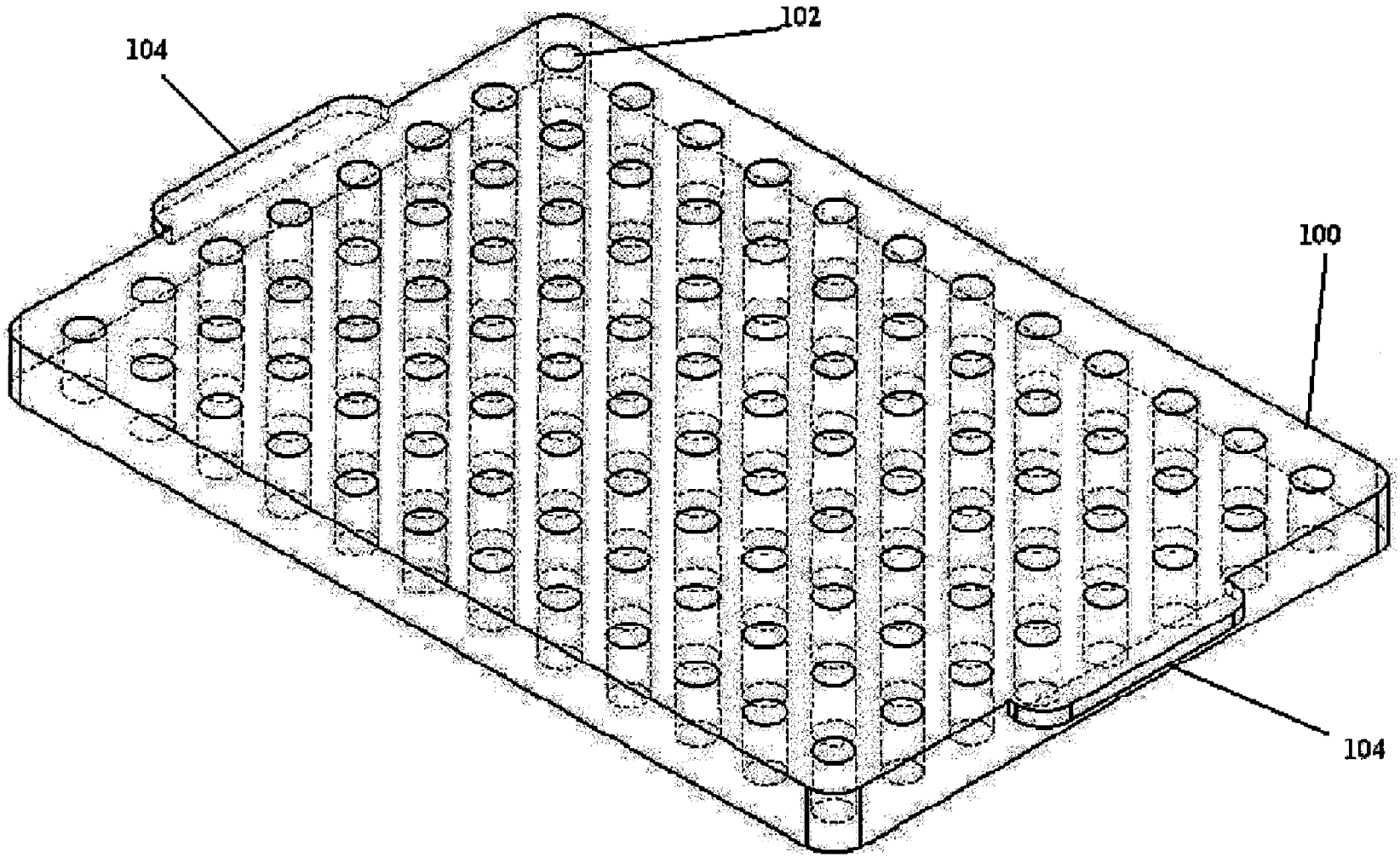
FIG. 1 is a perspective view of the current invention.

FIG. 1 gives a perspective view of the current invention connected with the plurality of pipette tips showing the connection between the tip collar invention and its ability to assemble together a plurality of pipette tips. FIG. 1 shows the tip collar 100, a plurality of axially placed holes 102, and a plurality of protruding tabs 104.

The tip collar 100 here is shown to be connected to the plurality of pipette tips to provide structural rigidity to the pipette tips. In this exemplary embodiment using Externally Sealed Pipette (ESP) tips, a bottom surface of the tip collar 100 sits on top surface of the shoulder flanges of the plurality of pipette tips to provide the desired structural rigidity. Alternatively, traditional internally sealed pipette tips can also be incorporated with the tip collar 100 by dropping the traditional internally sealed pipette tips into the tip collar 100 from the top surface of the tip collar 100. In this embodiment, the top surface of the tip collar 100 mates with the shoulder flanges of the traditional internally sealed pipette tip to provide the desired structural rigidity without departing from the scope of the present invention.

The tip collar 100, in the current exemplary embodiment is made out of a plastic material; however, the tip collar 100 can be made out of metal, aluminum, carbon fiber, or any other material that is capable of providing the desired structural rigidity without departing from the scope of the present invention. Furthermore, the tip collar 100 is currently shown to be in a rectangular shape in order to accommodate the plurality of pipette tips; however, the tip collar 100 can be in a square shape, triangular shape, circular shape, oval shape, or any other shape that is capable of assembling together the plurality of pipette tips without departing from the scope of the present invention.

Axially placed holes 102 are placed on the tip collar 100 to allow the plurality of pipette tips to be connected to the tip collar 100. Here, in the current exemplary embodiment, the axially placed holes 102 are arranged in a rectangular array; however axially placed holes 102 can be arranged in a circular fashion, a square fashion, a triangular fashion, or any other arrangement that allows for connection with corresponding pipette tips without departing from the scope of the present invention. Moreover, in the current exemplary embodiment, axially placed holes 102 are arranged to conform to the overall shape of the tip collar 100 to maximize space. However, the axially placed holes 102 can be arranged in a shape that is independent on the overall shape of the tip collar 100 without departing from the scope of the present invention. The axially placed holes may be cylindrical.

The protruding tabs 104 are used to create an area of contact, which allows an operator to easily grip onto the tip collar 100. The protruding tabs 104 extrude out of the side walls of the tip collar 100. In the current invention, the protruding tabs 104 and the tip collar 100 are made out of a unitary piece of plastic. However, the protruding tabs 104 can form its own separate entity attached to the tip collar 100, or even non-existent from the tip collar 100 without departing from the scope of the present invention.

Figure 2:
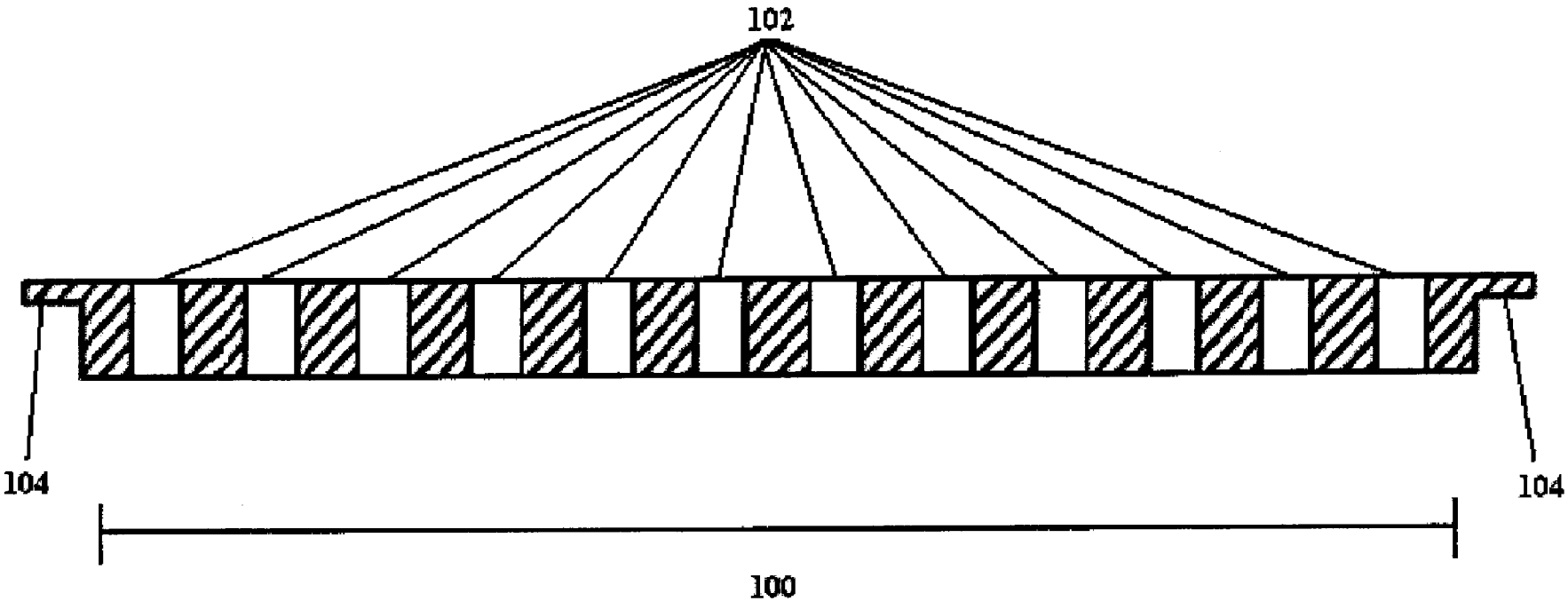
FIG. 2 is a side view of the current invention without a plurality of pipette tips showing the plurality of axial holes.

FIG. 2 shows a side view of the current invention showing the tip collar 100, axially placed holes 102, the plurality of protruding tabs 104 from FIG. 1 without any pipette tips.

The tip collar 100 shown here in demonstrates the relationship between an axially placed hole 102, and its neighboring holes. Here in the current embodiment, axially placed holes 102 are arranged in a rectangular array allowing for maximum number of axially placed holes within the tip collar 100. The axially placed holes 102, can also be arranged in a square array, triangular array, circular array, or any other array shape that is capable of accommodating a plurality of axially placed holes 102 without departing from the scope of the present invention.

Figure 3:
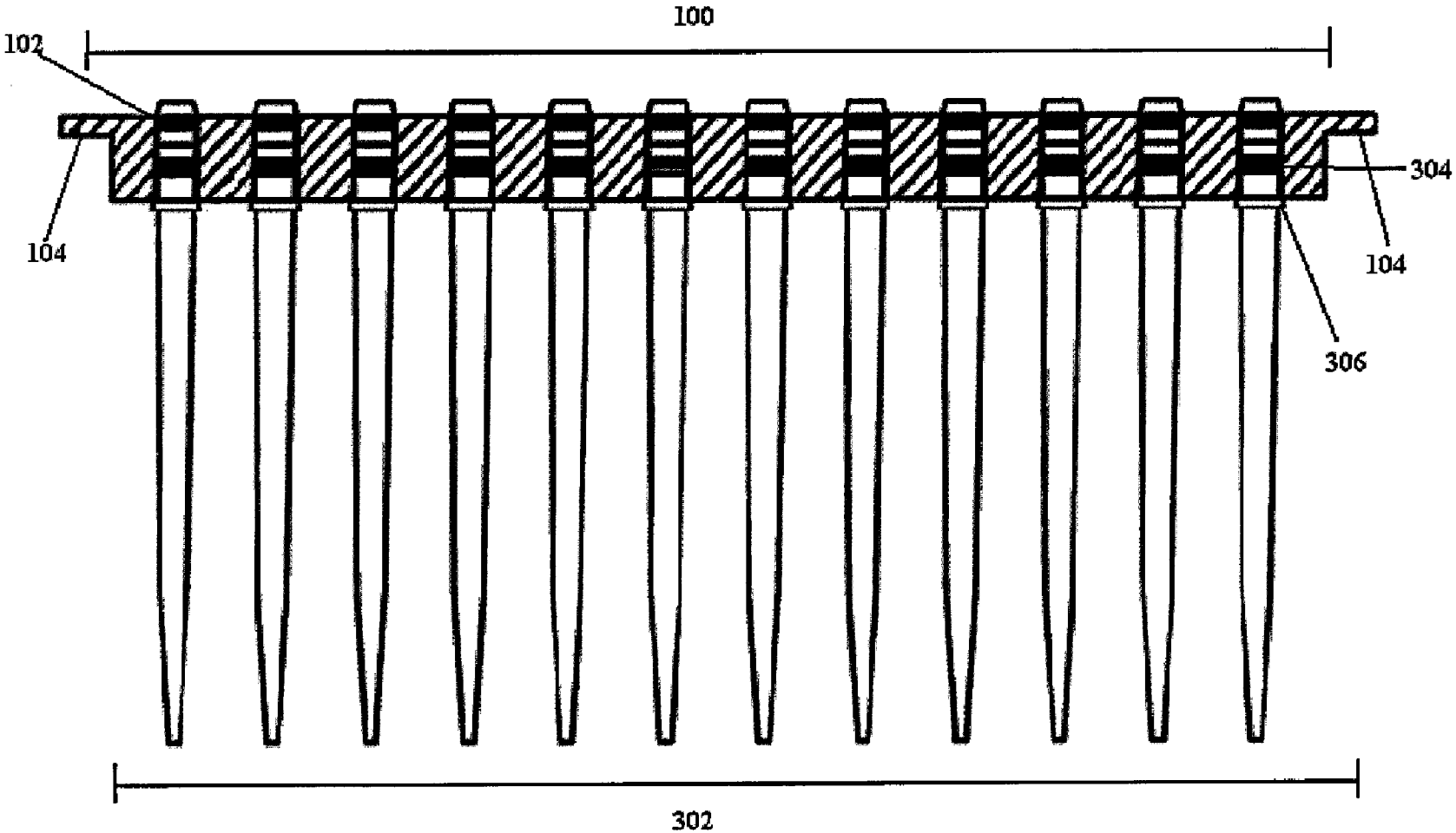
FIG. 3 is a side view of the current invention shown to be installed above the top surface of the pipette tip.

FIG. 3 illustrates a side view of the current invention showing the tip collar 100, the axially placed holes 102, the plurality of protruding tabs 104 as shown in FIG. 1. However, the internal workings of the pipette tips have been shown here as plurality of pipette tips 302 have been added to show the interrelationship between the plurality of pipette tips 302, and the axially placed holes 102 of the tip collar 100, resting on the shoulder flanges 306.

The plurality of pipette tips 302 are shown here to be connected to the tip collar 100. The external diameter of the plurality of pipette tips 302 matches the internal diameter of axially placed holes 102. In the current embodiment, the tip collar 100 fits itself near the top surface of plurality of pipette tips 302 to achieve the desired structural rigidity. Having the tip collar 100 closer to the point of seal at the top surface of plurality of the pipette tips 302 provides extended structural rigidity to the plurality of pipette tips. However, as shown later in FIG. 4, traditional internally sealed pipette tips can also be used in a different method without departing from the scope of the present invention.

The shoulder flange 306 here in the current embodiment shows the connection between the tip collar 100 and the plurality of pipette tips 302. In the current exemplary embodiment, the tip collar 100 rests on top of the shoulder flange 306 of the pipette tips 302, utilizing to create the desired structural rigidity to allow the entire tip collar 100 to be moved together with the attached plurality of pipette tips 302. However, as shown later in FIG. 4, traditional internally sealed pipette tips can also be used wherein the shoulder flange 306 rests on top of the tip collar 100 without departing from the scope of the present invention.

Figure 4:
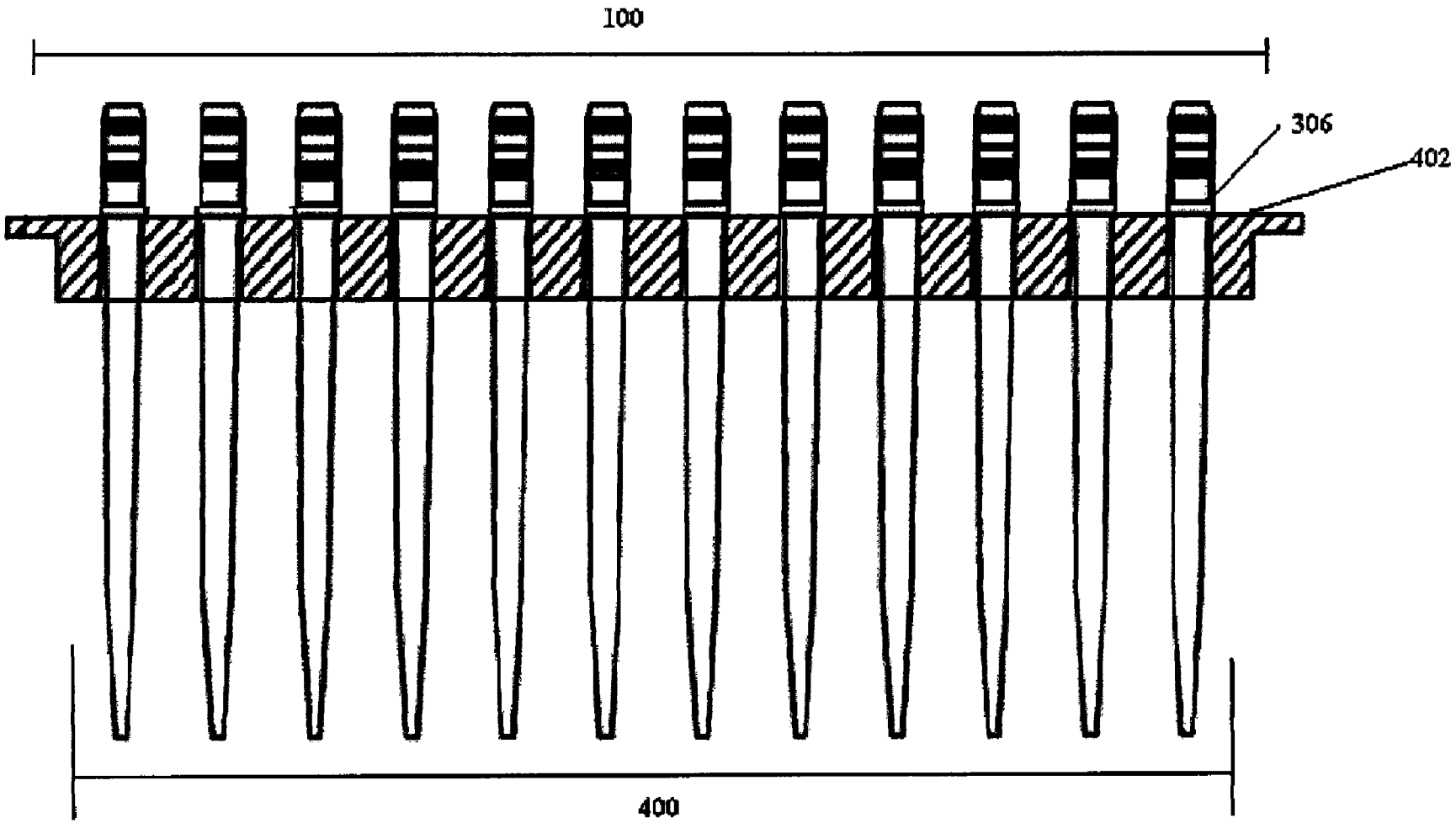
FIG. 4 is a side view of the current invention shown to be installed beneath a tip collar of the pipette tip.
Figures 5A, 5B:
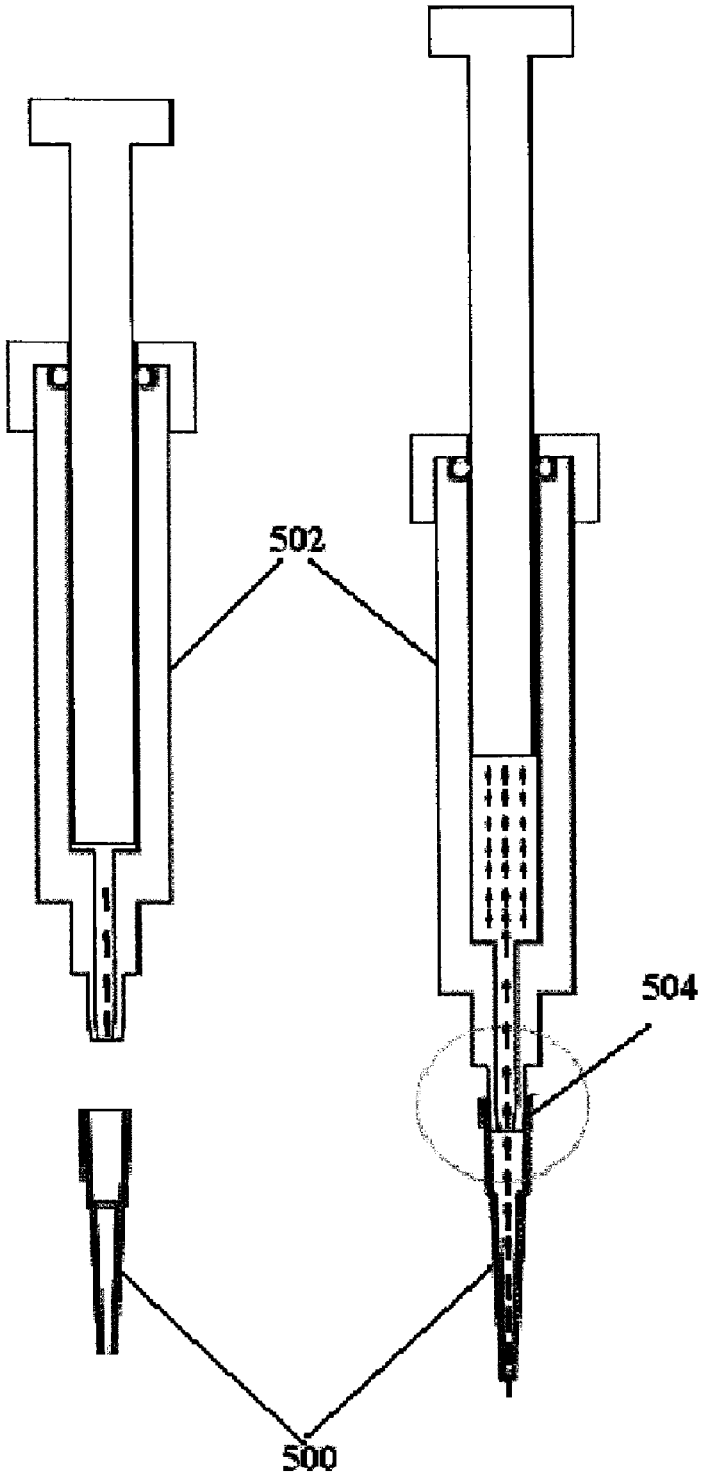
FIG. 5(a) FIG. 5(b) Prior Art
FIG. 5(*a*) is using a single shaft of a pipettor to illustrate the relationship between a prior art pipettor and a prior art pipette tip right before the connection is made.

FIG. 4 shows another embodiment of the current invention allowing the tip collar 100 to be connected to traditional internally sealed pipette tips 400 by dropping the pipette tips 400 into the axially placed holes 102 and using the shoulder flange 306 to determine the depth of travel when the top surface 402 of the traditional internally sealed pipette tips 400 meets with the tip collar 100.

In FIG. 4, for illustrative purposes, the plurality of pipette tips 302 is used because of the location of the shoulder flange 306.

Figures 6A, 6B:
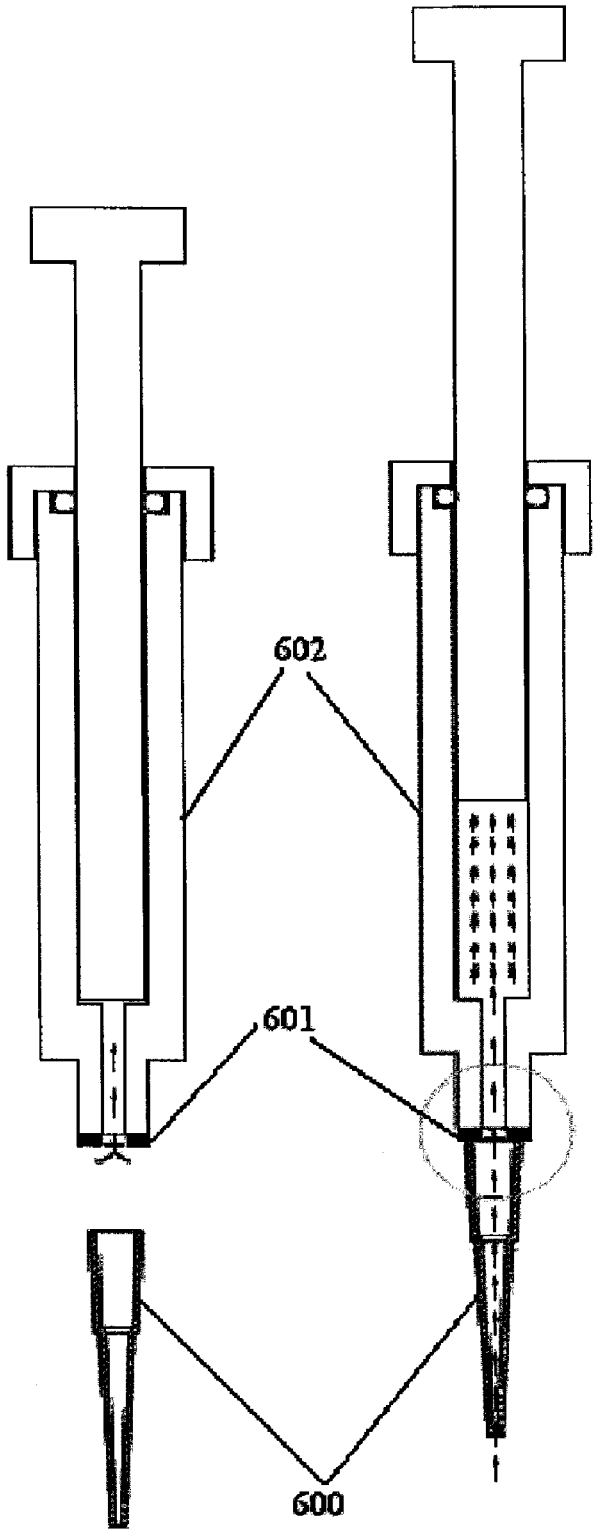
FIG. 6(*a*) illustrates the relationship between a pipettor utilizing the current invention and a pipette tip also utilizing the current invention right before the connection is made.

FIG. 6(*a*) shows the pipette tip 600 and pipettor 602 right before the two components are connected. FIG. 6(*b*) shows the current innovative connection between the pipette tip 600 and the pipettor 602 by lifting the pipette tip 600 upwards toward the pipettor 602, allowing a seal to be created at a gasket 601 at the bottom surface of the pipettor 602.

By utilizing the current invention involving the tip collar, the pipette tip 600 can create a unitary structurally solid object, thus allowing the pipette tip 600 to be raised to fit the pipettor 602 and for a seal to be created at the gasket 601. By eliminating the need to use a downward axial force that is needed to impinge the pipette tips, a seal can be created at the bottom surface of the pipettor 602, allowing for an ease of assembly. Moreover, the difficulties in properly aligning multiple pipette tips 600 to the pipettor 602 is also eliminated by using the tip collar, as the pipette tips locations relative to one another is fixed by the tip collar. Although in the current exemplary embodiment, the pipette tips 600 are lifted by an upward lifting force to create the desired seal, the pipette tips 600 can be held stationary, while moving the pipettor 602 downward to generate the same seal without departing from the scope of the present invention.

Figure 7:
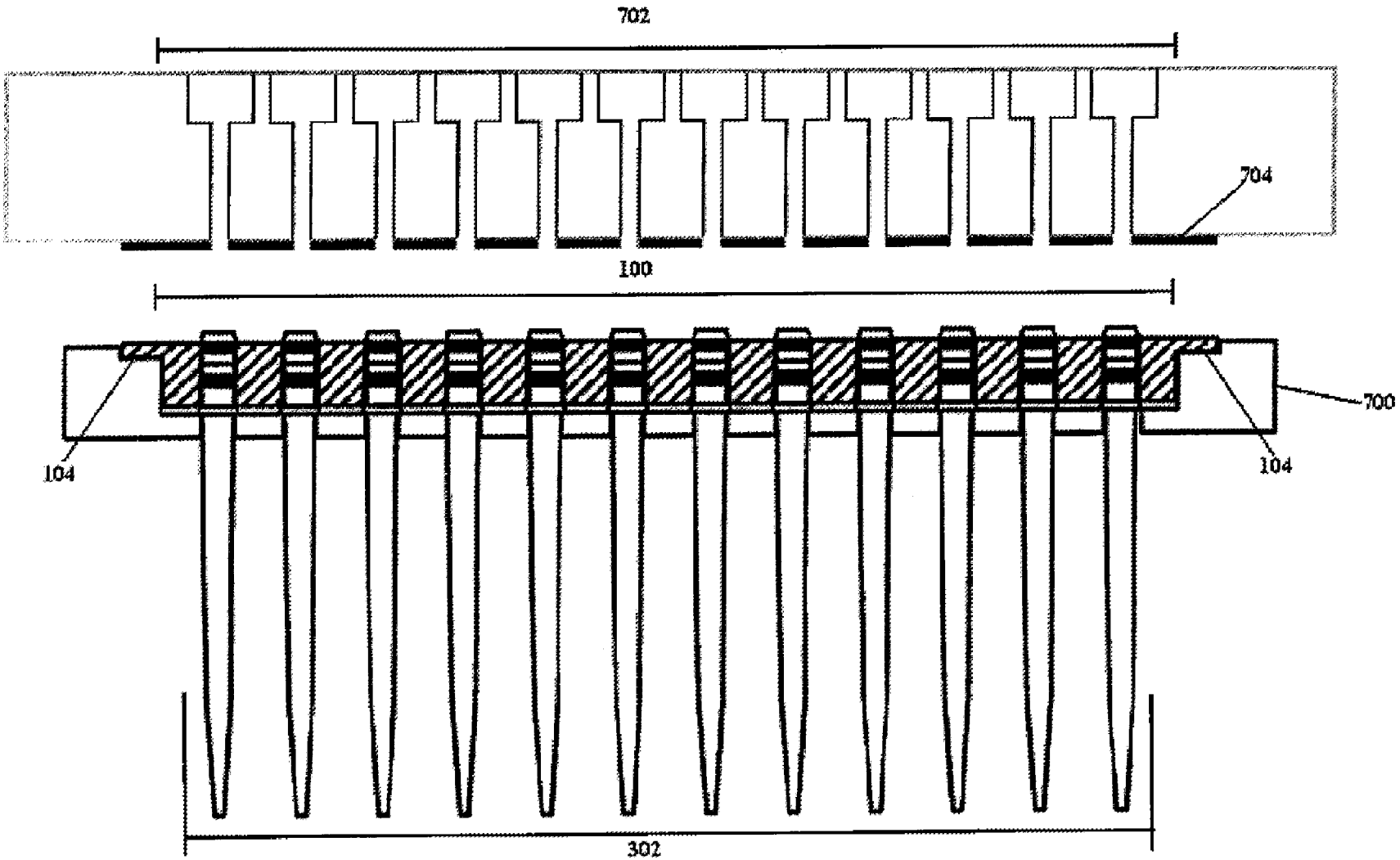
FIG. 7 is illustrative of the relationship between a plurality of pipettor using the current invention and a plurality of pipette tips using the current invention right before the connection is made.

FIG. 7 illustrates a sectional view of the current innovative seal described above in the FIG. 6 as applied to the plurality of pipette tips using the tip collar to provide structural rigidity.

As shown in FIG. 7, the tip collar 100 is connected to the plurality of pipette tips 302 to allow the assembling together of plurality of pipette tips 302. Furthermore, the figure shows a pipetting head adaptor 700 adapted to connect to the plurality of pipette tips 302 and the tip collar 100, to provide an upward lifting force. The pipetting head adaptor 700 allows the pipette tips 302 to mate with the pipettor 702 utilizing a gasket 704 installed at the bottom of the pipettor 702.

In this current embodiment, the pipette tips 302 are first connected to the tip collar 100 by inserting the plurality of pipette tips 302 into the axially placed holes of the tip collar 100 from the bottom. Once all the desired pipette tips 302 are installed within the tip collar 100, the entire assembly set of pipette tips 302 is dropped into the pipetting head adaptor 700, which applies an upward lifting force to bring the pipette tips 302 up towards the gasket 704 at the bottom of the pipettor 702.

In the current exemplary embodiment, the pipetting head adaptor 700 is often used to fit into an automatic pipettor machine to provide the necessary upward lifting force to create the desired seal. Bottom surface of the tip collar 100 fits snugly on the top surface of the shoulder flange 306, and the upward lifting force is generated by the top surface of the pipetting head adaptor 700 being connected to the bottom surface of the shoulder flange 306. When such upward lifting force is generated, the entire assembly set of pipette tips are brought up to the gasket 704 of the pipettor 702 to create the necessary seal.

The protruding tabs 104 of the tip collar 100 allow the operator to easily grip onto the tip collar 100 and place the assembly set into the pipetting head adaptor 700.

The pipetting head adaptor 700 in the current exemplary embodiment also has individual holes corresponding to the pipette tips 302 to ensure a secure fit between the pipette tips 302 and the pipetting head adaptor 700. The individual holes within the pipetting head adaptor 700 fit underneath the shoulder flange 306 to distribute the upward lifting force evenly amongst the pipettes.

The pipettor 702 here in the current exemplary embodiment functions in the same way as the pipettor 602 shown previously in FIG. 6 by attaching itself to the corresponding pipette tips 302. The pipettor 702 is generally connected to an automatic pipetting apparatus that helps extract a fluid sample using the pipette tips 302. Pipettor 702, as shown in the current embodiment has twelve individual external connectors; however, Pipettor 702 can have any number of external connectors that corresponds to the number of pipette tips 302 without departing from the scope of the present invention.

The gasket 704 as shown in the exemplary embodiment is used to create the desired seal between the pipette tips 302 and the pipettor 702. The seal, using the current tip collar 100 invention allows the seal to be created at the top surface of the pipette tips 302 or any pipette tip without departing from the scope of the present invention. The gasket 704 can be made out of a plastic material, however the gasket 704 can be made out of silicone, rubber, or any other material that contains elasticity to create the desired seal without departing from the scope of the present invention.

Figure 8:
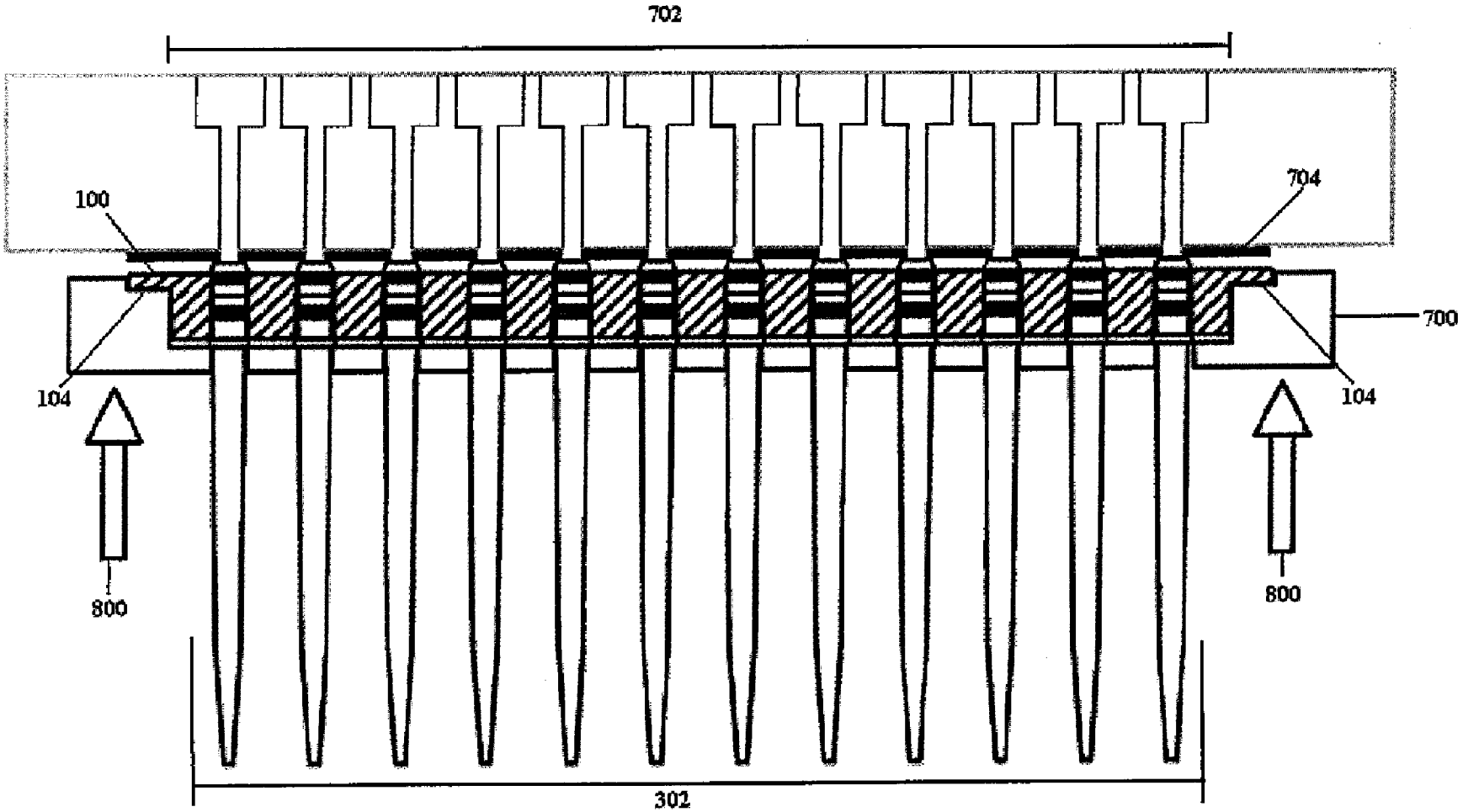
FIG. 8 is illustrative of the relationship between a plurality of pipettor using the current invention and a plurality of pipette tips using the current invention after the parts have been connected creating multiple seals.

FIG. 8 illustrates a sectional view of the current innovative seal described above in FIG. 6 connected to a plurality of pipette tips using the tip collar to provide structural rigidity.

As shown in FIG. 8, an upward lifting force 800 has pushed the pipette tips 302, the tip collar 100, along with pipetting head adaptor 700 to mate with the gasket 704 of the pipettor 702.

Upward lifting force 800 can be generated manually through levers; however, upward lifting force 800 can also be generated automatically through machines, pumps, or any other device capable of generating an upward lifting force without departing from the scope of the present invention.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A tip collar for assembling together a plurality of pipette tips each having a shoulder flange comprising:

a plurality of protruding tabs placed along a pair of opposing edges of said tip collar; and a plurality of axially placed holes on said tip collar adaptable to receive said plurality of pipette tips;

wherein said tip collar allows said plurality of pipette tips to rigidly rest therein by forming an assembly set of pipette tips, wherein said assembly of pipette tips and said pipettor are connected by an upward lifting force exerted on a shoulder flange of each of said plurality of pipette tips.

2. The tip collar of claim 1, wherein said upward lifting force is distributed by mating a top surface of a pipetting head adaptor with a bottom surface of said shoulder flange.

* * * * *